US007712851B2

(12) United States Patent
Huang et al.

(10) Patent No.: US 7,712,851 B2
(45) **Date of Patent: *May 11, 2010**

(54) SLIDE RAIL ASSEMBLY

(75) Inventors: Kuo-Ming Huang, Taipei Hsien (TW); Mo-Ming Yu, Shenzhen (CN); Zong-Yuan Li, Shenzhen (CN)

(73) Assignees: Hong Fu Jin Precision Industry (ShenZhen)Co., Ltd., Shenzhen City, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 327 days.

This patent is subject to a terminal disclaimer.

(21) Appl. No.: 11/782,651

(22) Filed: Jul. 25, 2007

(65) Prior Publication Data

US 2008/0135714 A1 Jun. 12, 2008

(30) Foreign Application Priority Data

Dec. 8, 2006 (CN) ..... 2006 1 0201250

(51) Int. Cl.
*A47B 88/00* (2006.01)

(52) U.S. Cl. ..... 312/333; 312/334.46

(58) Field of Classification Search ..... 312/333, 312/334.44–334.47, 319.1, 334.1, 334.7, 312/334.8; 384/20–22
See application file for complete search history.

(56) References Cited

U.S. PATENT DOCUMENTS

| | | | | |
|---|---|---|---|---|
| 6,749,276 | B2 * | 6/2004 | Judge et al. | 312/334.47 |
| 6,851,774 | B2 * | 2/2005 | Chen et al. | 312/334.47 |
| 7,404,611 | B1 * | 7/2008 | Que | 312/334.46 |
| 7,552,982 | B2 * | 6/2009 | Beaudoin | 312/334.47 |
| 2004/0201340 | A1 | 10/2004 | Chen et al. | |
| 2008/0124009 | A1 * | 5/2008 | Peng et al. | 384/21 |
| 2008/0150409 | A1 * | 6/2008 | Huang et al. | 312/334.46 |
| 2008/0159670 | A1 * | 7/2008 | Huang et al. | 384/18 |
| 2009/0001864 | A1 * | 1/2009 | Huang et al. | 312/333 |

* cited by examiner

*Primary Examiner*—Janet M Wilkens
(74) *Attorney, Agent, or Firm*—Frank R. Niranjan

(57) ABSTRACT

A slide rail assembly includes a first slide rail having a release portion, a second slide rail having a slot, a third slide rail having a stop portion, a latch member slidably attached to a slot of the second slide rail, and a resilient member connected to the latch member for returning the latch member to an original position. The latch member includes a first engaging portion and a second engaging portion located at opposite sides of the second slide rail. Wherein the first engaging portion engages with the stop portion of the third slide rail such that the third slide rail is capable of driving the second slide rail to slide together relative to the first slide rail. The release portion of the first slide rail is capable of engaging with the second engaging portion to bias the latch member to slide along the slot to release the third slide rail from the first engaging portion.

12 Claims, 6 Drawing Sheets

SLIDE RAIL ASSEMBLY

BACKGROUND OF THE INVENTION

1. Field of the Invention

The present invention relates to a slide rail assembly.

2. Description of Related Art

Slide rails are used in a variety of applications, including business furniture, kitchen drawers, electronic racks, and copiers. One type of slide rail is a telescopic slide rail. Telescopic slide rails often include two, three, four or more telescoping members. The shape of a slide rail, and the individual members, are determined by the design. The slides can be frictional, with lubricated members rubbing against each other, or a slide assembly may include roller or ball bearings for easier movement. The members in such assemblies tend to be C-shaped in nature.

A conventional three-section slide rail assembly for a drawer includes a first slide rail (e.g. outer slide rail), a second slide rail (e.g. middle slide rail), and a third slide rail (e.g. inner slide rail). A ball bracket is sandwiched between any two of the first slide rail, the second slide rail, and the third slide rail to provide a smooth sliding movement. In such basic slide mechanisms; the order in which the second slide rail extends relative to the first slide rail and the third slide rail extends relative to the second slide rail is unpredictable. Considerations of strength and smoothness of operation may render a given order or sequence preferable in a given slide configuration. Further, activation of external mechanisms such as cabinet interlocks may require a specific sequence of operation.

Consequently, it is required to provide a slide rail assembly having a latch mechanism urging collapsing of slide rails in a specific desired order.

SUMMARY OF THE INVENTION

In one preferred embodiment, a slide rail assembly includes a first slide rail having a release portion, a second slide rail having a slot, a third slide rail having a stop portion, a latch member slidably attached to a slot of the second slide rail, and a resilient member connected to the latch member for returning the latch member to an original position. The latch member includes a first engaging portion and a second engaging portion located at opposite sides of the second slide rail. Wherein the first engaging portion engages with the stop portion of the third slide rail such that the third slide rail is capable of driving the second slide rail to slide together relative to the first slide rail. The release portion of the first slide rail is capable of engaging with the second engaging portion to bias the latch member to slide along the slot to release the third slide rail from the first engaging portion.

Other advantages and novel features of the present invention will become more apparent from the following detailed description of preferred embodiment when taken in conjunction with the accompanying drawings, in which:

DETAILED DESCRIPTION OF THE INVENTION

Figure 1:
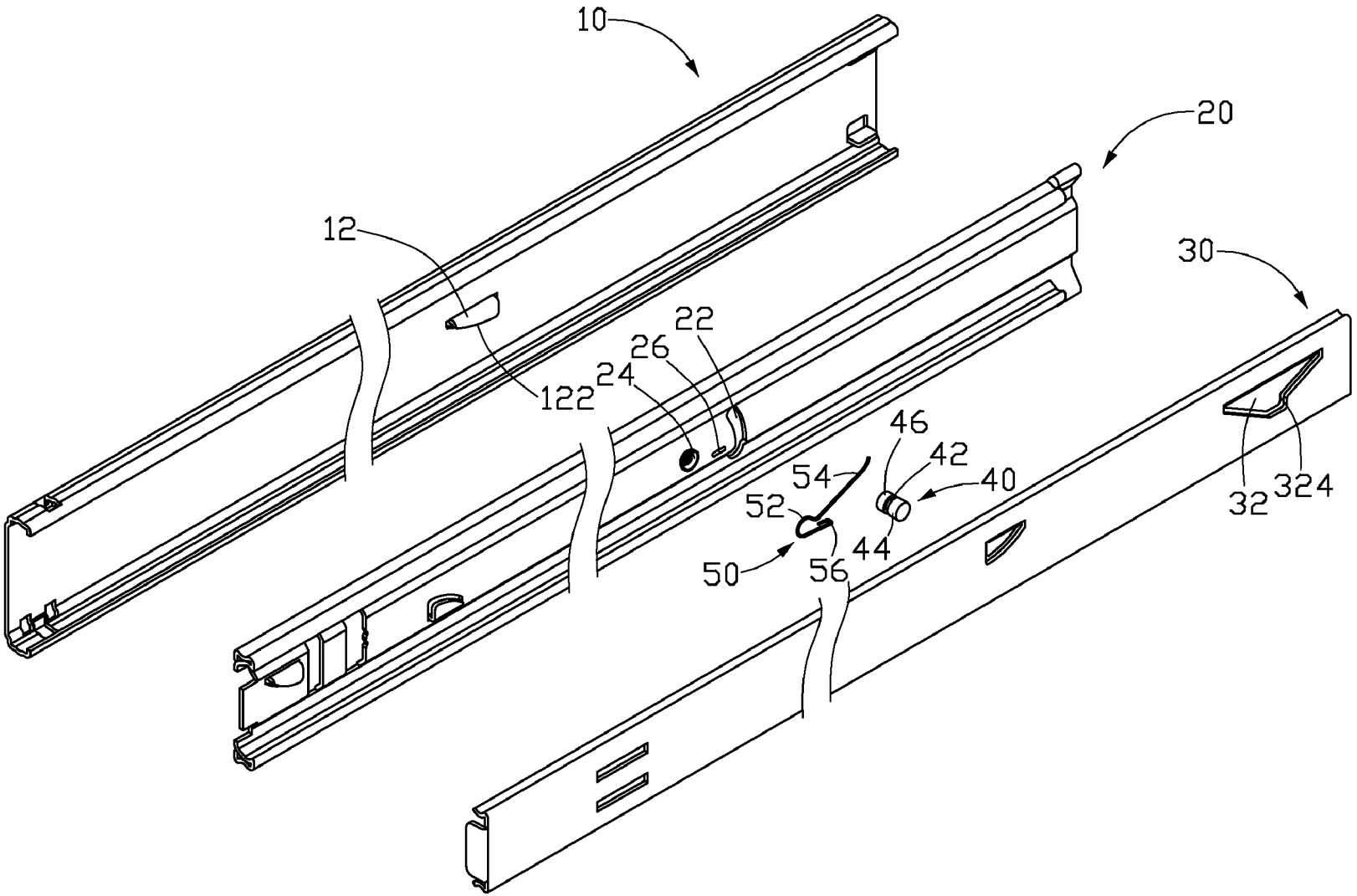
FIG. 1 is an exploded, isometric view of the slide rail assembly according to a preferred embodiment of the present invention.
Figure 2:
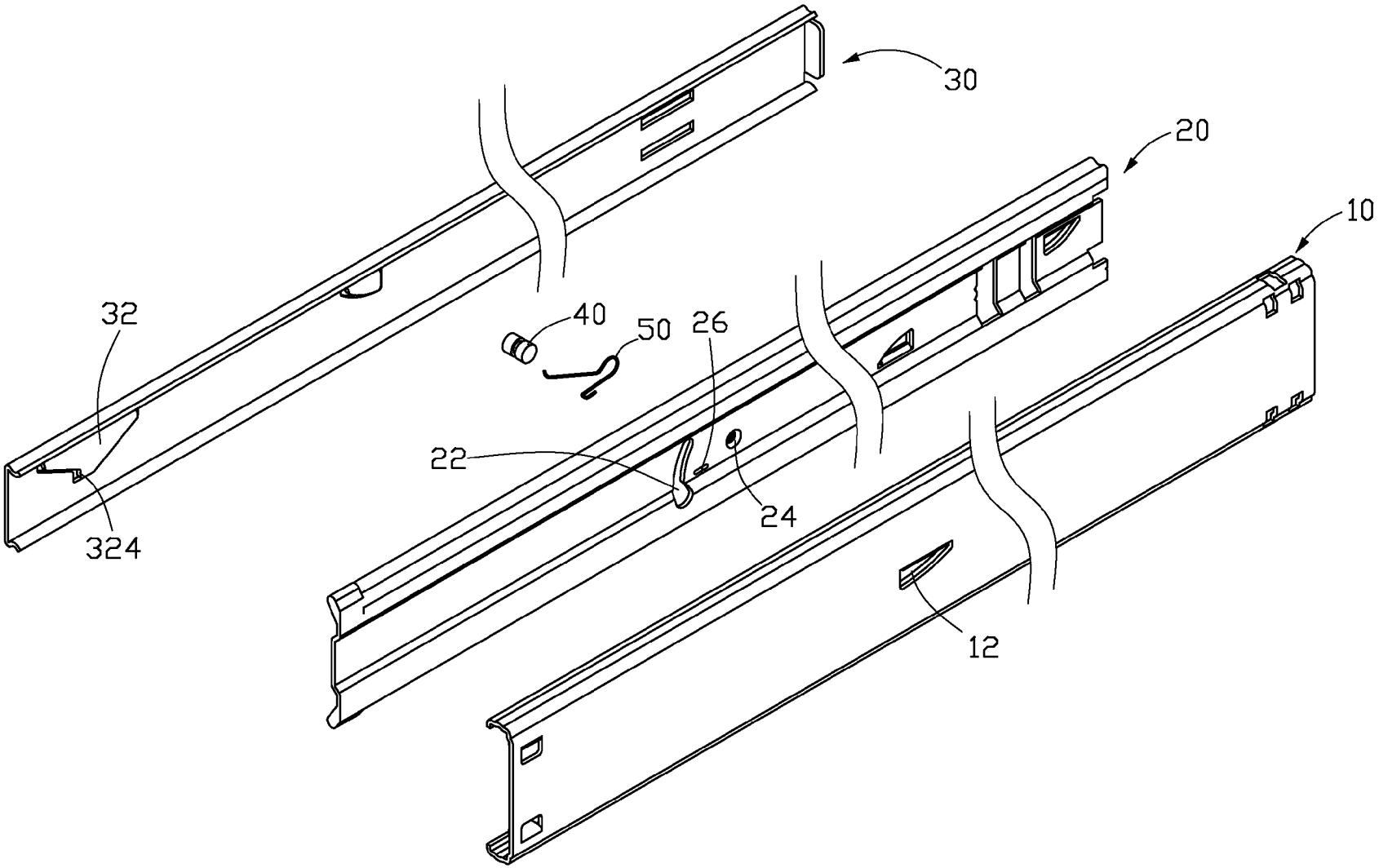
FIG. 2 is an inverted view of FIG. 1.

Referring to FIGS. 1 and 2, in an embodiment of the invention, a slide rail assembly includes a first slide rail 10, a second slide rail 20, a third slide rail 30, a latch member 40, and a resilient member 50.

The first slide rail 10 includes a bottom wall and two sidewalls extend from opposite sides of the bottom wall. A release portion 12 extends inward from the bottom wall of the first slide rail 10 at a predetermined releasing position. The release portion 12 includes an inclined surface 122 formed at a free side thereof.

The second slide rail 20 includes a bottom wall and two sidewalls extending from opposite sides of the bottom wall respectively. The second slide rail 20 includes an arc-shaped slot 22 defined in the bottom wall at a predetermined retaining position, a protrusion 24 formed on the bottom wall thereof, and an aperture 26 defined in the bottom wall between the slot 22 and the protrusion 24. The slot 22 has a larger end and a smaller end.

The third slide rail 30 includes a bottom wall and two sidewalls extending from opposite sides of the bottom wall respectively. A stop portion 32 is formed on the bottom wall of the third slide rail 30 in the vicinity of one end of the third slide rail 30. The stop portion 32 has a stop surface 324 formed thereon adjacent to the one end of the third slide rail 30.

The latch member 40 is generally column-shaped. A neck portion 42 is defined in a middle portion of the latch member 40. A first engaging portion 44 and a second engaging portion 46 are formed on opposite ends of the latch member 40 respectively.

The resilient member 50 is generally R-shaped, and preferably made by bending a resilient steel wire. The resilient member 50 includes a mounting portion 52 at a middle thereof, and a pressing portion 54 and a locking portion 56 at opposite ends thereof respectively.

Figure 3:
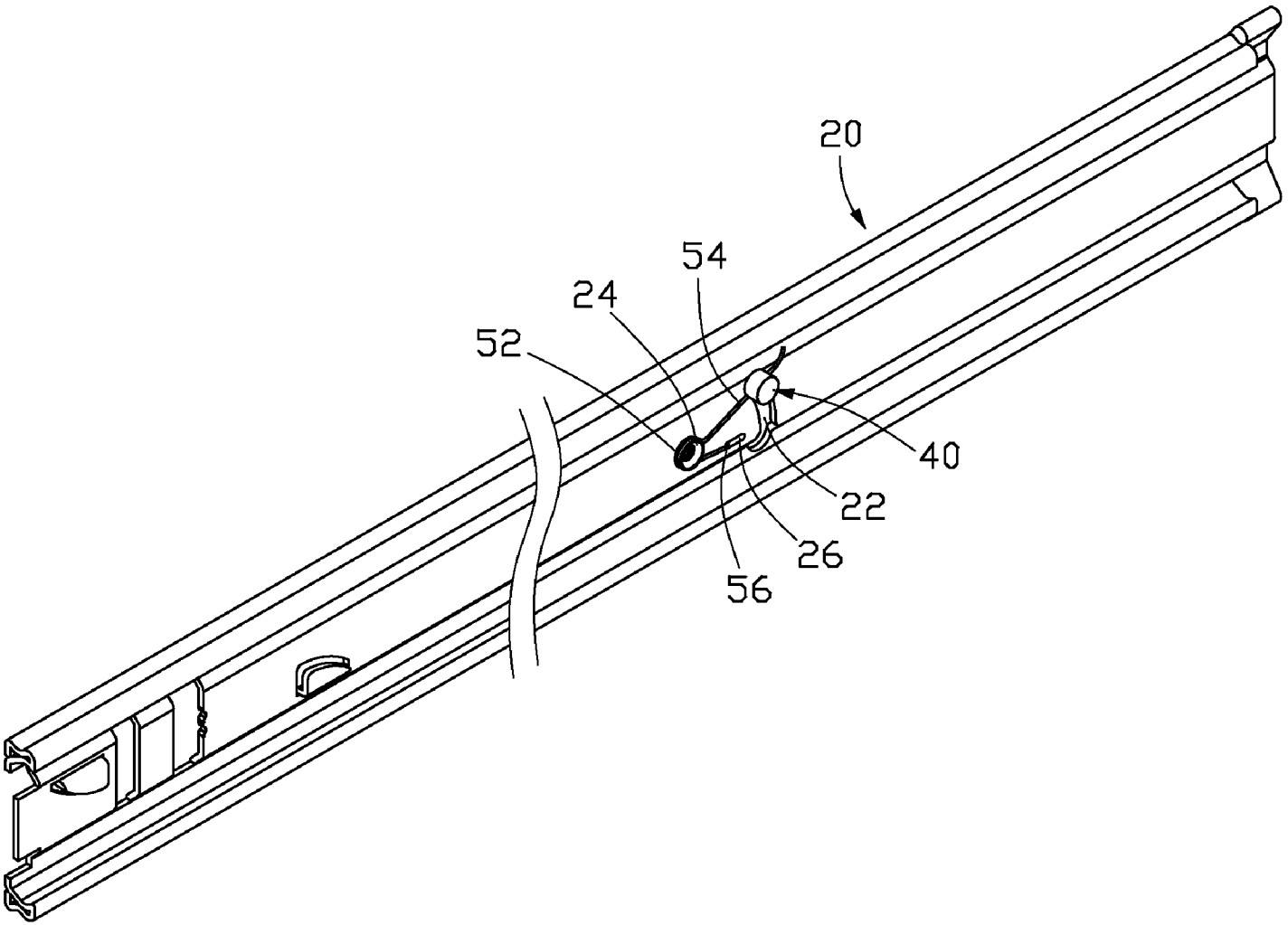
FIG. 3 is an partially assembled view of FIG. 1.
Figure 4:
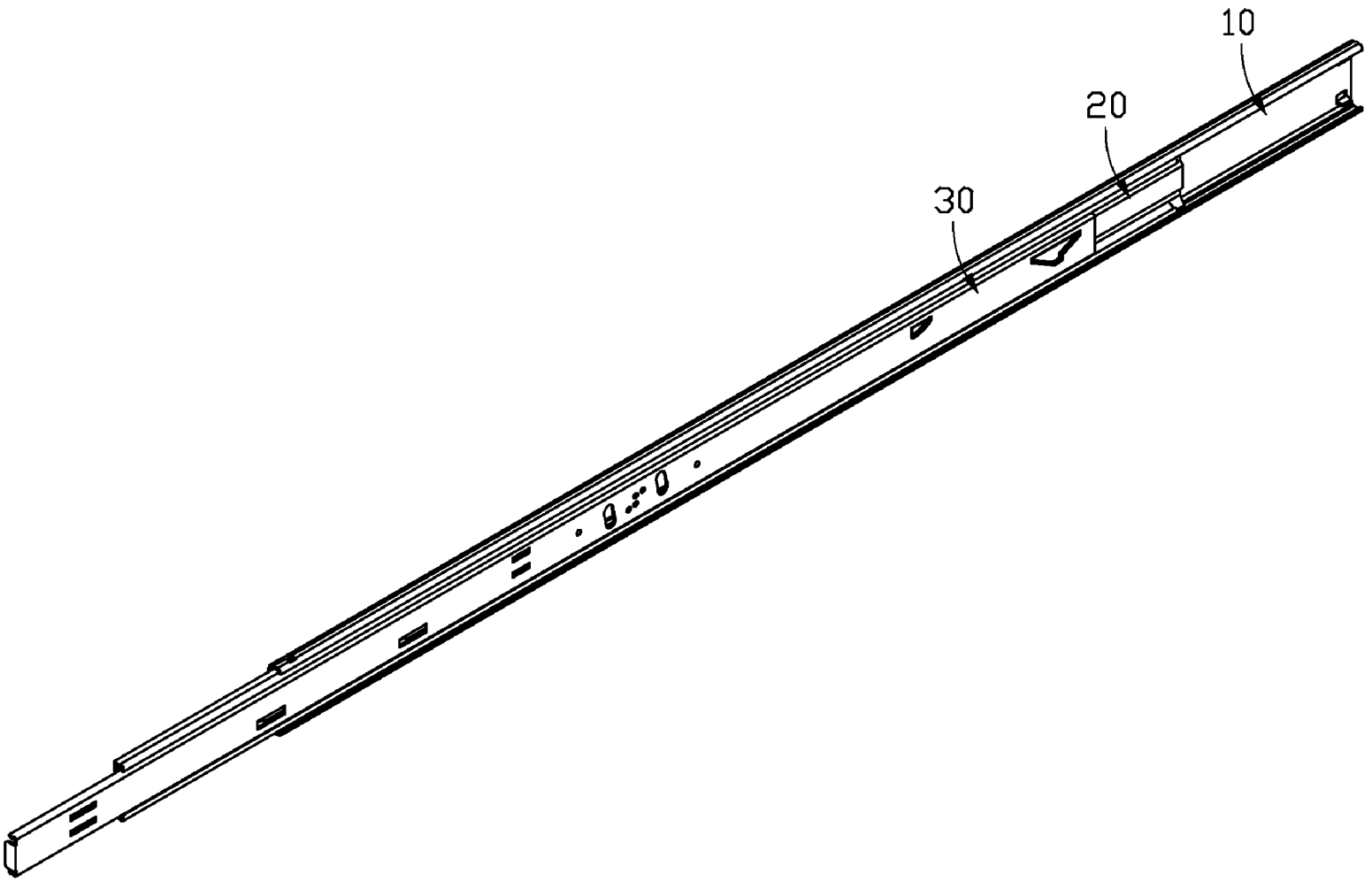
FIG. 4 is an assembled view of FIG. 1.

Referring also to FIGS. 3 and 4, in assembly, the latch member 40 is inserted into the slot 22 of the second slide rail 20 via the larger end and biased to the smaller end. Two sidewalls bounding the slot 22 engage in the neck portion 42 of the latch member 40. The mounting portion 52 of the resilient member 50 is fixed around the protrusion 24 of the second slide rail 20. The locking portion 56 of the resilient member 50 is locked in the aperture 26 of the second slide rail 20. The pressing portion 54 of the resilient member 50 presses on the neck portion 42 of the latch member 40. The first to third slide rails 10, 20, 30 are nested in sequence to form the slide rail assembly.

Figure 5:
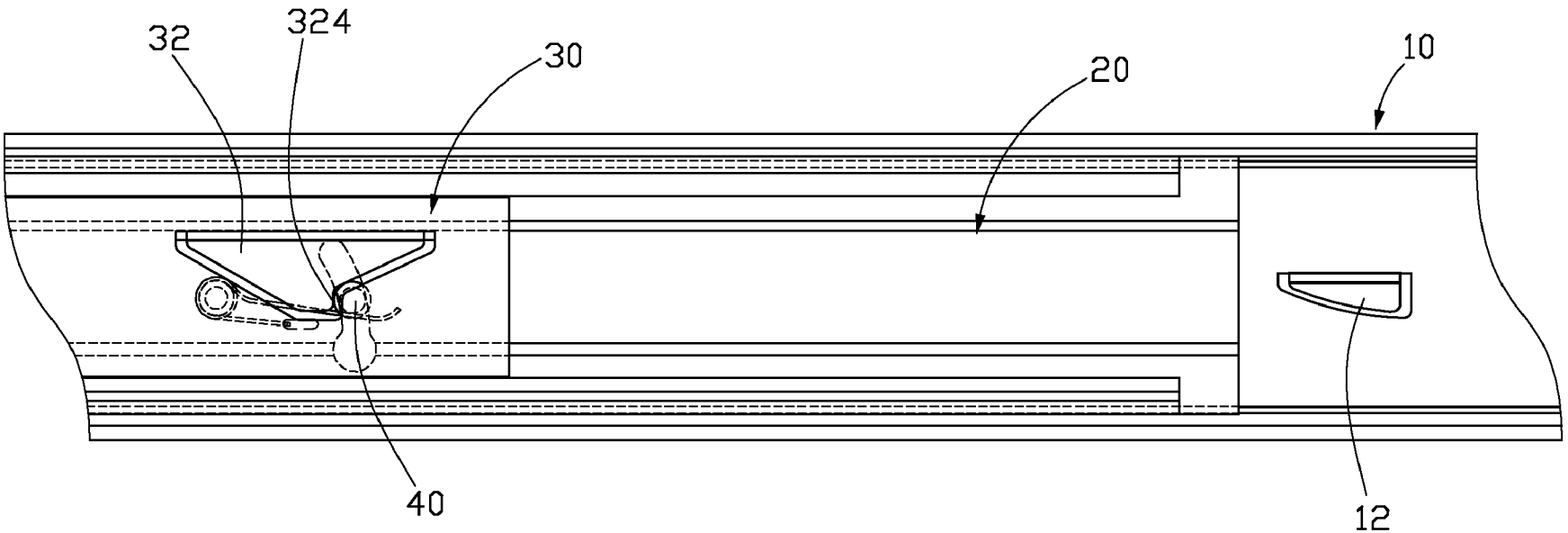
FIGS. 5 and 6 are lateral views of FIG. 4 showing the slide rail assembly in two states.

Referring also to FIG. 5, in collapsing the slide rail assembly from an extended state, the third slide rail 30 is pushed to slide into the second slide rail 20. When the stop portion 32 of the third slide rail 30 arrives at the latch member 40, the stop surface 324 of the stop portion 32 engages with the first engaging portion 44 of the latch member 40 to drive the second slide rail 20 simultaneously to collapse into the first slide rail 10.

Figure 6:
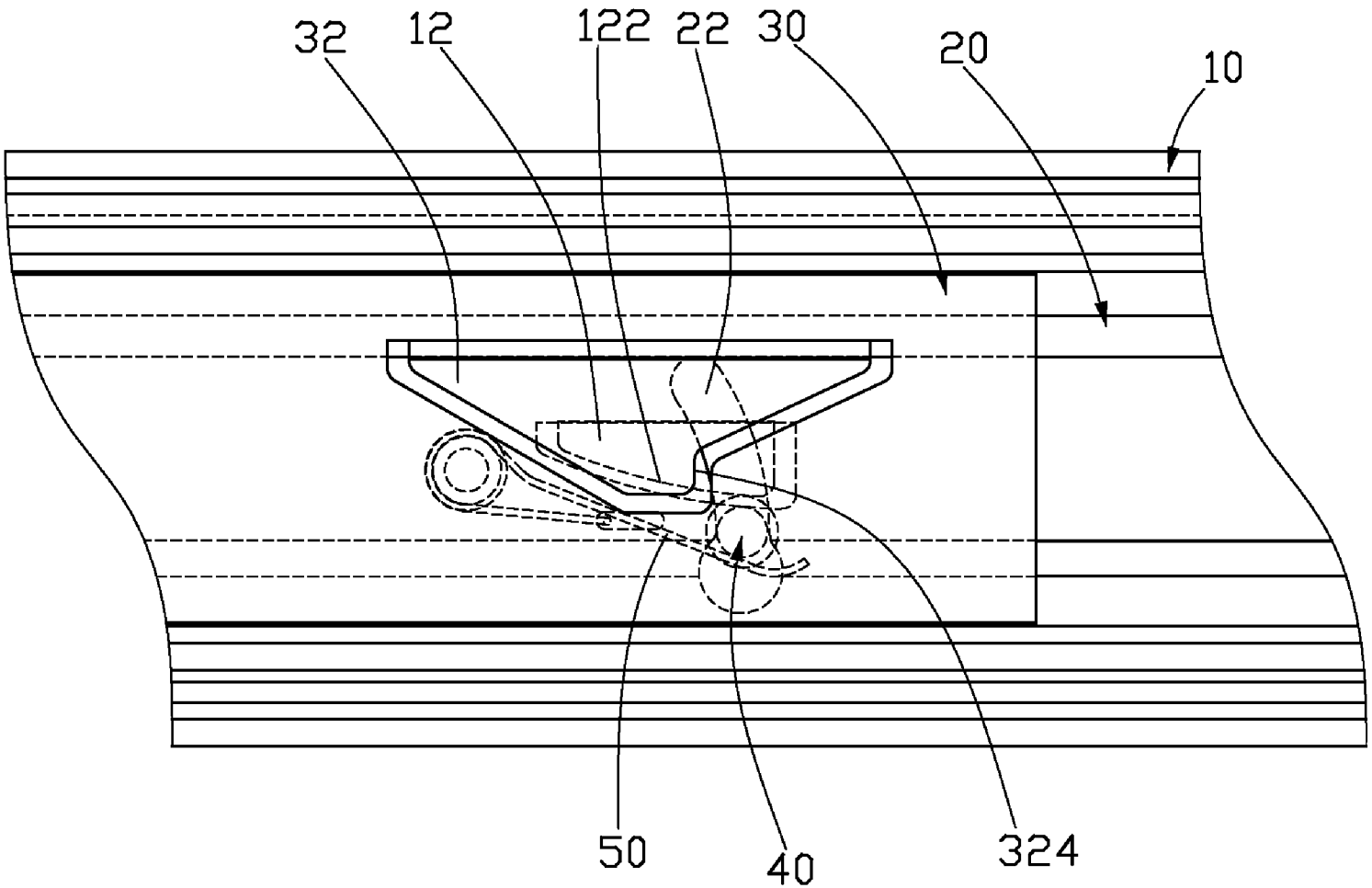

Referring also to FIG. 6, when the latch member 40 arrives at the release portion 12 of the first slide rail 10, the inclined surface 122 of the release portion 12 presses the second engaging portion 46 of the latch member 40 to drive the latch member 40 to slide toward the larger end of the slot 22 of the second slide rail 20 along the slot 22 against resistance of the resilient member 50 until the first engaging portion 46 of the latch member 40 disengages from the stop surface 122 of the stop portion 12, and the third slide rail 30 continues to slide into the second slide rail 20. The resilient member 50 restores the latch member 40 toward the smaller end of the slot 22 of the second slide rail 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slide rail assembly comprising:

a first slide rail;

a second slide rail slidably attached to the first slide rail;

a third slide rail slidably attached to the second slide rail;

a latch member slidably attached to a slot of the second slide rail, the latch member comprising a first engaging portion and a second engaging portion located at opposite sides of the second slide rail;

a stop portion arranged on the third slide rail configured to engage with the first engaging portion of the latch member attached to the second slide rail such that the third slide rail is capable of driving the second slide rail to slide together relative to the first slide rail;

a release portion arranged on the first slide rail, the release portion capable of engaging with the second engaging portion of the latch member to bias the latch member to slide along the slot to release the stop portion from the first engaging portion; and a resilient member placed between the latch member and the second slide rail for returning the latch member to an original position.

2. The slide rail assembly as described in claim 1, wherein the latch member is generally column-shaped, a neck portion is defined in a middle portion of the latch member and slidably engaged with two sidewalls bounding the slot of the second slide rail to slidably attach the latch member to the second slide rail.

3. The slide rail assembly as described in claim 2, wherein the slot has a larger end and a smaller end, the latch member is inserted into the slot from the larger end and is biased to the smaller end by the resilient member.

4. The slide rail assembly as described in claim 3, wherein one end of the resilient member engages with the neck portion of the latch member for keeping the latch member to the smaller end of the slot.

5. The slide rail assembly as described in claim 1, wherein the resilient member is generally R-shaped, and made by bending a resilient steel wire, the resilient member comprises a mounting portion at a middle thereof, and a pressing portion and a locking portion at opposite ends thereof respectively.

6. The slide rail assembly as described in claim 5, wherein the second slide rail comprises a protrusion formed on a bottom wall thereof, and an aperture defined in the bottom wall between the slot and the protrusion, the mounting portion of the resilient member is arranged around the protrusion of the second slide rail, the locking portion of the resilient member is locked in the aperture of the second slide rail, the pressing portion of the resilient member presses on the neck portion of the latch member.

7. The slide rail assembly as described in claim 1, wherein the release portion of the first slide rail comprises an inclined surface for driving the latch member to slide along the slot of the second slide rail.

8. The slide rail assembly as described in claim 1, wherein the stop portion of the third slide rail forms a stop surface for engaging with the first engaging portion of the latch member.

9. A slide rail assembly comprising:

a first slide rail having a release portion arranged thereon;

a second slide rail having a slot defined therein;

a third slide rail forming a stop portion thereon;

a latch member being attached to the second slide rail and slidable along the slot of the second slide rail, the latch member comprising a first engaging portion and a second engaging portion at opposite ends of the latch member respectively, the first and second engaging portions being located at opposite sides of the second slide rail, wherein the first engaging portion of the latch member is capable of engaging with the stop portion of the third slide rail to allow the second slide rail and the third slide rail to slide in together relative to the first slide rail, the release portion of the first slide rail is capable of engaging with the second engaging portion of the latch member to drive the latch member along the slot of the second slide rail to disengage the first engaging portion from the stop portion of the third slide rail thereby releasing the third slide rail from the second slide rail to allow the third slide rail to further slide in relative to the first and second slide rails;

a resilient member connected to the latch member for restoring the latch member.

10. The slide rail assembly as described in claim 9, wherein the latch member traverses through the slot, a neck portion is formed between the first and second engaging portions of the latch member and slidably engaged with two sidewalls bounding the slot to thereby slidably lock the latch member to the second slide rail.

11. The slide rail assembly as described in claim 10, wherein the resilient member is generally R-shaped, and made by bending a resilient steel wire, the resilient member comprises a mounting portion at a middle thereof, a pressing portion and a locking portion at opposite ends thereof respectively, the second slide rail comprises a protrusion formed on a bottom wall thereof, and an aperture defined in the bottom wall between the slot and the protrusion, the mounting portion of the resilient member is arranged around the protrusion of the second slide rail, the locking portion of the resilient member is locked in the aperture of the second slide rail, the pressing portion of the resilient member presses on the neck portion of the latch member.

12. The slide rail assembly as described in claim 9, wherein the release portion of the first slide rail comprises an inclined surface for driving the latch member to slide along the slot of the second slide rail, the stop portion of the third slide rail forms a stop surface for engaging with the first engaging portion of the latch member.

* * * * *